US006245721B1

(12) United States Patent
Chun et al.

(10) Patent No.: US 6,245,721 B1
(45) Date of Patent: Jun. 12, 2001

(54) LUBRICATION ADDITIVE COMPOSITION

(76) Inventors: Peter Chun, 2753 A W. Long Dr., Littleton, CO (US) 80120; John A. Elverum, 11513 W. 101st Ave., Westminster, CO (US) 80021

( * ) Notice: Subject to any disclaimer, the term of this patent is extended or adjusted under 35 U.S.C. 154(b) by 0 days.

(21) Appl. No.: 09/432,875

(22) Filed: Nov. 2, 1999

(51) Int. Cl.[7] ..... C10M 131/14; C10M 125/04; C10M 101/02

(52) U.S. Cl. ..... 508/151; 508/123; 508/150; 508/181; 508/589

(58) Field of Search ..... 508/589, 123, 508/151, 150, 181

(56) References Cited

U.S. PATENT DOCUMENTS 4,078,010 * 3/1978 Prillieux et al. .
4,155,860 * 5/1979 Soucy .
4,204,968 5/1980 Mack et al. ..... 252/26
4,654,403 * 3/1987 Tipton .
4,844,825 * 7/1989 Sloan .
4,915,856 4/1990 Jamison ..... 252/26
5,171,461 * 12/1992 DiBiase et al. .
5,431,830 7/1995 Erdemir ..... 252/25
5,723,419 * 3/1998 Czerwinski et al. .
5,767,046 6/1998 Cusumano et al. ..... 508/443
5,772,747 6/1998 Turner et al. ..... 106/33
5,856,524 1/1999 Dietz et al. ..... 549/283
5,885,942 3/1999 Zhang et al. ..... 508/184
6,028,038 * 2/2000 Kusch .

* cited by examiner

*Primary Examiner*—Jerry D. Johnson
(74) *Attorney, Agent, or Firm*—John E. Reilly

(57) ABSTRACT

The lubricant additive formulation for introduction into a petroleum based carrier, such as, motor oil, in which the additive contains substantially equal amounts of naphthenic oil and chlorinated paraffin with minor amounts of a paraffin oil and anti-wear and anti-oxidant agents; and in certain applications, metal powders or soaps are introduced into the additive together with an effective amount of grease necessary to maintain the metal particles in suspension when introduced into the liquid carrier.

18 Claims, No Drawings

LUBRICATION ADDITIVE COMPOSITION

BACKGROUND AND FIELD OF INVENTION

This invention relates to lubrication additives and more particularly relates to a novel and improved lubrication additive composition characterized by its anti-oxidant and anti-wear properties and is particularly adaptable for use in internal combustion engines to substantially reduce friction between metal surfaces and to realize increased mileage.

Lubrication additive formulations have been devised to promote improved lubrication in various applications, such as, internal combustion engines. In the past, these have included the use of chlorinated paraffinic oils, naphthenic oils, as well as various types of wetting/lubrication aids. Moreover, it has been proposed to use minute metal particles suspended in a petroleum based oil in the formulation of a lubrication additive for internal combustion engines and reference is made to U.S. Pat. No. 4,204,968 for lubricant additive which is incorporated by reference herein. By way of illustration, for an automobile crank case application, the '968 patent discloses a formulation of one to two ounces of metal particles, 20 microns or smaller, made up of 60% copper, 40% lead, three to four ounces of a 40 w high premium motor oil together with a small amount of grease to maintain the metal particles in suspension.

U.S. Pat. No. 4,915,856 to Jamison is directed to a solid lubrication additive containing metal particles in combination with a polymeric carrier and a tackifier to increase adhesion of the additive materials with metal surfaces. It is believed however that the tackifier may actually increase the drag between the opposing metal surfaces, particularly at lower temperatures. As a solid lubricant composition, Jamison is intended more for use in coating external wear surfaces, such as, the wheel flanges on a railcar.

Although the hereinbefore described metal particle-containing additives have performed adequately, there is a continuing need to provide a metal particle-containing additive of the type described with improved anti-friction, anti-oxidant and anti-wear properties. More specifically, as applied to its primary intended application as a crank case oil or transmission oil, it is important to enhance the anti-friction and lubricating properties of the additive by providing better wetting and coating of the appropriate metal surfaces while being capable of sustaining its performance at extreme pressure and temperature levels. In this setting, it is also highly desirable to avoid the use of phosphate compounds as an ingredient in the additive.

Accordingly, there is a continuing need for a novel and improved liquid lubricant additive which when added to engine oil or transmission oil products has the ability to coat metal surfaces over wide temperature and pressure ranges, such as for example, coating the relatively moving metal surfaces of an internal combustion engine; also to provide improved anti-friction, anti-oxidant, anti-wear properties in the oil into which it is introduced.

SUMMARY OF THE INVENTION

It is therefore an object of the present invention to provide for a novel and improved liquid lubricant additive composition which is conformable for use in a wide range of applications.

It is another object of the present invention to provide for a novel and improved lubricant composition which is liquid at room temperature, capable of wetting relatively moving metal surfaces during operation while promoting lubrication and decreasing the rate of oxidation of hydrocarbon oils.

It is a further object of the present invention to provide for a novel and improved lubrication additive composition having excellent anti-friction, anti-oxidant and anti-wear properties leading to improved performance and extended service life while promoting increased mileage in internal combustion engines.

Still a further object of the present invention is to provide a lubricant additive composition that protects rubbing, relatively moving metal surfaces with adequate wetting and lubrication in combination with metal particles that will plate or smear onto the metal surfaces; and further wherein the metal particles are capable of acting much in the nature of ball bearings and are characterized by vastly improved wear properties when used in combination with selected liquid lubricant compounds.

The present invention resides in a novel and improved liquid lubricant additive formulation which comprises the following composition in wt. %:

33–65 naphthenic oil;
2–24 paraffinic oil;
30–50 chlorinated paraffin;
up to 2 wetting and lubrication aid;
up to 2 anti-oxidant; and
up to 7 anti-oxidant and anti-wear additive.

In a modified but alternate preferred form of invention, a liquid lubricant additive formulation comprises the following composition in wt. %:

20–65 naphthenic oils;
25–50 chlorinated paraffins;
2–40 paraffin oils;
up to 11 grease;
up to 60 selected from the group consisting of soft, malleable metal powders and metal soaps;
up to 7 anti-wear/anti-oxidant agents;
up to 2 anti-oxidant agents; and
up to 2 wetting aids.

From the foregoing, there are two distinct but related types of anti-friction lubrication additives in accordance with the present invention: one type is a group of formulations without solid lubricant ingredients and the other type includes solid lubricant ingredients, such as, metal powders, or metal soaps of fatty acids. The formulations without solid lubricant ingredients have demonstrated advantages over the prior art including reduced wear and friction during testing and consequent lack of heat buildup to the metal surfaces during friction tests. The formulations with the solid lubricant ingredients, particularly those containing metal powders, such as, copper, lead and zinc, also demonstrated reduced wear and friction during testing as well as increased gasoline mileage.

There has been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent construction insofar as they do not depart from the spirit and scope of the present invention.

The above and other objects, advantages and features of the present invention will become more readily appreciated and understood from a consideration of the following detailed description of preferred forms of the present invention.

DETAILED DESCRIPTION OF PREFERRED EMBODIMENT

The embodiments of the present invention may be best typified by describing their use as additives for a motor oil for internal combustion engines. At the time of an engine oil change, the preferred lubrication additive is added at a ratio of 4 oz. to 8 oz. of additive to 4 to 5 quarts of commercial grade motor oil (1:16 or 1:20). Addition is directly into the designated engine oil port. The engine may be operated in "park" or "neutral" for 5 to 10 minutes to adequately mix the engine oil and additive. For a transmission oil change, the preferred additive of the present invention is added at a ratio of 2 oz. of additive per quart of transmission oil (1:16). Addition is directly into the designated transmission oil port, and again the engine is operated in "park" or "neutral" for about 5 to 10 minutes to adequately mix the oil and additive.

For the purpose of illustration but not limitation, one preferred formulation of the present invention adapted for use as an engine oil and transmission oil additive is made up of a mixture of major proportions of naphthenic oil and chlorinated paraffin with minor proportions of paraffinic oil, a wetting and lubrication agent, anti-oxidant and anti-wear agents. The wetting agent or metal processing surfactant serve to wet the metal surfaces and lower the surface tension of the oil phase in contact with the metal surfaces when used in combination with hydrocarbon oils. The high temperature/high pressure performance of the hydrocarbon oils is enhanced with the presence of the chlorinated paraffins, and the anti-oxidants decrease the rate at which the hydrocarbon oils oxidize. Test data indicates that the lubrication additives substantially reduces friction between metal surfaces and promotes increased mileage both in gas and diesel internal combustion engines.

In another preferred composition which is intended more for use in a crankcase oil, the additive comprises major proportions of naphthenic oils and chlorinated paraffins as well as paraffin oils with minor proportions of anti-oxidant/anti-wear agents together with selected metal particles which enhance wetting and lubrication of metal surfaces. The anti-wear agent, also referred to as a metal processing surfactant, serves to wet and lubricate the metal surfaces when used in conjunction with hydrocarbon oils. The high temperature/high pressure performance of the hydrocarbon oils is further enhanced with the presence of the chlorinated paraffins, and the anti-oxidants decrease the rate at which the hydrocarbon oils oxidize. The addition of metal particles, particularly lead and copper, reduce friction between moving metal engine surfaces as they function as small ball bearings and platelets. At high temperatures and pressures, the metal particles, such as, the copper particles will plate on high wear surfaces where the base metal has been removed by wear. Test data indicates that the additive mixture as described with the further addition of metal particles or metal soaps substantially reduces friction between relatively moving metal surfaces and contributes to improved gasoline mileage.

Working examples are given in Table I of the lubricant additive formulations of the present invention without metal or metal compounds.

TABLE I

| Ingredients (By pct/wt) | 1 | 2 | 3 | 4 | 5 | 6 | 7 | 8 | 9 |
|---|---|---|---|---|---|---|---|---|---|
| Naphthenio oil | | | | | | | | | |
| CALSOL ® 810 | | | 57.33 | 58.99 | 33.21 | | 57.50 | 50.00 | 36.27 |
| CALSOL ® 8240 | 47.00 | 62.88 | | | | 51.73 | | | |
| Paraffinic oil | | | | | | | | | |
| Sunpar 150 | | | 4.31 | 2.63 | 23.42 | 11.53 | 6.00 | 6.00 | 6.37 |
| LP150 | 3.00 | 3.00 | | | | | | | |
| Chlorinated Paraffins | | | | | | | | | |
| CW625 | | | | 18.20 | 23.42 | 27.18 | | | |
| CW235U | 49.00 | | | | | | | | |

TABLE I-continued

| Ingredients (By pct/wt) | 1 | 2 | 3 | 4 | 5 | 6 | 7 | 8 | 9 |
|---|---|---|---|---|---|---|---|---|---|
| CW60 | | 33.00 | 36.64 | 19.30 | 19.19 | 8.24 | 36.00 | | |
| Kloro 60-50 | | | | | | | | 42.00 | 47.56 |
| Anti-Oxidant | | | | | | | | | |
| WingstayC | 1.00 | 1.00 | 0.86 | 0.44 | 0.38 | 0.66 | | | |
| WingstayT | | | | | | | 0.50 | | |
| Anti-Oxidant/Antiwear | | | | | | | | | |
| Vanlube 871 | | | | | | | 1.00 | 2.00 | 2.45 |
| Wetting/Lubrication Aid | | | | | | | | | |
| Witcamide 511 | | 0.20 | 0.86 | 0.44 | 0.38 | 0.66 | | | |
| Non-Metal Additive | | | | | | | | | |
| Graphite | | | | | | | | | 7.35 |

The naphthenic oils of the lubrication additive are available from R. E. Carroll, Inc., 1570 North Olden Avenue, Trenton, N.J. 08638. Cal506 810 has specific gravity of 0.9100, molecular weight of 305, pour point of −40° F., aromatics of 36.3%, and saturates of 63.6%. Cal506 8240 has specific gravity of 0.9433, molecular weight of 394, pour point of 20° F., aromatics of 43.5%, and saturates of 55.3%.

The paraffinic oil of the lubrication additive is available from R. E. Carroll, Inc., 1570 North Olden Avenue, Trenton, N.J. 08638 or Witco Corporation, One American Lane, Greenwich, Conn. 06831. Sunpar 150 has a specific gravity of 0.8762, molecular weight of 517.0 and pour point of 5° F. LP-150 has a specific gravity of 0.881 and pour point of −40° C.

The wetting/lubrication aid of the lubrication additive is available from the Witco Corporation, 15200 Almeda Road, Houston, Tex. 77053. Witcamide 511 is a tall oil fatty acid diethanolamide having a specific gravity of 0.955, dark amber color, and pH of 9–10.

The chlorinated paraffins of the lubrication additive are available from Ferro (Heil Chemical Division) and are distributed by Hall Technologies, Inc., 1424 Atlantic, North Kansas City, Mo. 64116. Kloro 60-50 is a chlorinated paraffin with chain length of $C_{14}$–$C_{17}$, chlorine content 52%, specific gravity of 1.25 and pour point of 25° F. CW-60 is a chlorinated paraffin, chlorine content 60%, specific gravity of 1.35, and pour point of 30° F. CW-235 is a chlorinated paraffin, chlorine content 46%, specific gravity of 1.21, and pour point of 20° F. CW-625 is a chlorinated paraffin, chlorine content of 50%, specific gravity of 1.27 and pour point of 65° F.

The anti-oxidants of the lubrication additive are available from Goodyear Chemicals, Akron, Ohio 44316. WITCAMIDE® T is a straw-colored butylated octylated phenol having molecular weight of 260–374 and specific gravity of 9.90. Winstay C is a straw-colored butylated (dimethylbenzyl) phenol having molecular weight of 386 and specific gravity of 1.01.

The anti-oxidant/anti-wear agent in the additive is available from R. T. Vanderbilt Company, Inc., 30 Winfield Street, Norwalk, Conn. 06856. VANLUBE® 871 is an amber-colored 2,5-dimercapto-1,3,4-thiadiazole derivative with a density of 1.11.

Optimum weight ranges for the composition of Table I are 33 to 65 wt. % naphthenic oil, 20 to 50 wt. % chlorinated paraffin, 2 to 12 paraffinic oils, and the balance selected from the anti-wear/anti-oxidant ingredients as listed.

Working examples are given for the purpose of illustration in Table II of preferred formulations of the lubricant additive of the present invention containing metals or metal compounds.

TABLE II

| Ingredients (By %/wt.) | 10 | 11 | 12 |
|---|---|---|---|
| Naphthenic Oil: | | | |
| CALSOL ® 810 | 35.339 | 35.0 | 24.00 |
| CALSOL ® 8240 | | | |
| Paraffinic Oil: | | | |
| SUNPAR ® 150 | 4.112 | 8.0 | 36.67 |
| Chlorinated Paraffins: | | | |
| CW625 | | | |
| CW235U | | | |
| CW60 | | | |
| Kloro 60-50 | 40.398 | 44 | 26.27 |
| Lithium-Grease Complex #2 | 6.525 | | |
| Metal Powders: | | | |
| Copper Powder | 6.770 | 5.6 | |
| Lead Powder | 5.139 | | |
| Zinc Powder | | 5.4 | 3.33 |
| Copper Flake | | | |
| Metal Soap: | | | |
| Aluminum Stearate | | | 3.33 |
| Anti-Oxidant/Antiwear: | | | |
| VANLUBE ® 871 | 1.717 | 2.0 | 2.67 |
| Wetting/Lubrication Aid: | | | |
| WITCAMIDE ® 511 | | | |

Broadly, the metal particles may be characterized as one selected from soft, malleable metals and which are held in suspension by the lithium-grease complex #2 when introduced into the motor oil. Small, spherical metal particles (99%<20 microns) such as copper and lead are available from American Cyanamid and Atomized Products respectively. The lithium grease complex #2 is available from Silco Company. Other components, such as, polymeric materials, other soft, malleable metals, metal soaps or greases, and non-metal lubricants may also function well in these additive formulations.

It has been found that optimum ranges by % wt. of the metal-containing additives are 33–55% naphthenic oil, 4–6% paraffinic oil, 35–45% chlorinated paraffin, and 5–20% metal powders or soaps together with minor proportions of the anti-oxidant/anti-wear agents and a sufficient amount of grease to maintain the metal powders in suspension when introduced into the motor oil.

Corrosion testing was performed using the standard test method for detection of copper corrosion from petroleum products by the copper strip tarnish test. Basically, samples were collected from the crank case and transmission of an automobile after being driven 3,000 miles which contained samples of additives within the optimum ranges set forth for the non-metal and metal-containing additives.

Polished copper strips were placed separately in the four samples at 100° C. for three hours exposure. After exposure, the polished strips were visually rated according to the chart listed in the test method. Slight tarnish =1 which is indicative of little, if any corrosion observed. Corrosion=4 which is indicative of substantial corrosion.

Control solutions of hydrochloric acid (H—Cl) were also evaluated using a polished copper strip. The solutions included~3M hydrochloric acid (ph<1), and ~0.003M hydrochloric acid (pH~3.5). The pH of each of the solutions was measured using Baxter S/P pH indicator strips, pH range 0–14, Cat. P1119-5A. The copper strip was exposed to the HCl solutions at room temperature for about two hours.

Sample 1, Rating=1A (light orange, almost the same as freshly polished strip)

Sample 2, Rating=1B (dark orange)

Sample 3, Rating- 1B (dark orange)

Sample 4, Rating- 1B (dark orange)

The 3M hydrochloric acid solution caused immediate corrosion (Rating=4b, graphite or lusterless black) to the copper strip, and the 0.003M hydrochloric acid solution appeared to cause some slight corrosion (Rating=2e, brassy or gold or very slight 4a, transparent black or brown).

Note from the ASTM Method: The freshly polished strip is included in the series as an indication of the appearance of a freshly polished strip before a test run; it is not possible to duplicate this appearance after a test even with a completely non-corrosive sample.

The CLM anti-friction engine treatment (neat) and CLM anti-friction transmission treatment (neat) used in actual driving conditions for 3000 miles do not appear to contribute to corrosion as indicated by this ASTM test method.

Friction brake tests were carried out with the use of a Pro-Tech Race Wheel Test Device having a roller bearing in contact with another metal surface in which the metal surfaces were cleaned and polished with a stone and sanded with aluminum oxide sandpaper to remove any burrs. The Pro-Tech Race Wheel Test Device is available from the Timken Company, 1835 Dueber Avenue, SW 6932, Canton, Ohio. 44706-0932.

For the first trial, several ounces of oil were added to the reservoir of the race wheel and the wheel began rotating on idle at 5 amps. Weights were added to the arm that holds the roller bearing that was in contact with the race wheel until metal on metal grinding scarred the bearing. The weight load and force on the torque wrench that caused the roller bearing to cease rotating were recorded. After the first trial, the roller bearing was cleaned with WD-40 and placed in a new position with the race wheel.

For the second trial, about 2 ounces (56 g) of the CLM anti-friction crankcase or transmission treatment (Example 12) were mixed with a new quart of the Ultimate Code motor oil (32 oz.) After thorough mixing, several ounces of the mixture were placed in the reservoir of the race wheel and the wheel began rotating on idle at 5 amps. Weights were added every 15 seconds to the arm that holds the roller bearing that was in contact with the race wheel until the metal on metal grinding scarred the bearing. The maximum weight load and force on the torque wrench that was applied to the roller bearing were recorded.

For the third trial, a new roller bearing was used after it was cleaned with WD-40®. About 2 oz. (67.3 g) of the mixed CLM anti-friction engine treatment (CLM engine treatment product and Example 12) were mixed with a new quart of the ultimate cold motor oil (32 oz.). After thorough mixing, several ounces of this mixture were placed in the reservoir of the race wheel and the wheel began rotating on idle at 5 amps. Weights were added every 15 seconds to the arm that holds the roller bearing that was in contact with the race wheel until metal on metal grinding scarred the bearing. The maximum weight load and force on the torque wrench that was applied to the roller bearing were recorded.

For the first trial, 14 lb. of weights were placed on the arm of the roller bearing that caused it to stop rotating. This force measured 20 ft-lb. The wear scar on the roller bearing was 6.7 mm in length. At the end of the test, the roller bearing was quite hot to the touch.

For the second trial, the maximum of 84 lb. of weights was placed on the arm of the roller bearing and it continued to rotate. This force measured +115 ft-lb. The wear scar on the roller bearing was about 2.5 mm in length. At the end of the test, the roller bearing was not hot to the touch.

For the third trial, the maximum of 84 lb. of weights was placed on the arm of the roller bearing and it continued to rotate. This force measured +115 ft-lb. The wear scar on the roller bearing was about 2.6 mm in length. At the end of the test, the roller bearing was not hot to the touch.

The CLM anti-friction engine treatment and CLM anti-friction crankcase or transmission treatment mixed with a commercial oil product significantly reduced the friction, and increased the force required to wear and scar a rotating metal surface.

A number of road tests were conducted to evaluate the mileage performance of the additives in two vehicles. The vehicles included a 1998 SIENNA™ (Test Car #1) with 14,267 miles on the odometer at the start of the tests and a 1994 LAND CRUISER® Wagon (Test Car #2) with 48,629 miles at the start of the tests. The manufacturer's recommended highway mileage for Test Car #1 was 24 miles per gallon (mpg). The manufacturer's recommended highway mileage for Test Car #2 was 15 miles per gallon (mpg). At the beginning of the tests the vehicles were tuned, the tire pressure of 35 psi was monitored, the oil and oil filters were changed. The vehicles were driven on the test route and the mileage was recorded. The engine additive (Table I) and crankcase additive (Table II) were then added to each vehicle. Each vehicle was driven on the test route six times and the gas mileage was recorded for each trip.

The driving route (Roggen, Colorado to Big Springs, Nebr.) mileage (144 miles), and speed (65 mph set on cruise control) were constant for both vehicles for all the tests. The winds, road conditions and traffic were considered about the same for each test.

Test Results

| With Engine and Test Crankcase Additive | | Test Car #1 mpg | Test Car #2 mpg |
|---|---|---|---|
| #1 | No | 22.6 | 13.8 |
| #2 | Yes | 27.9 | 16.9 |
| #3 | Yes | 30.8 | 17.6 |
| #4 | Yes | 31.5 | 18.8 |
| #5 | Yes | 31.8 | 18.6 |
| #6 | Yes | 29.7 | 17.9 |
| #7 | Yes | 28.4 | 17.4 |
| Average mpg for six tests | | 30.0 | 17.9 |
| Average increase in mpg | | ~7 | ~4 |
| Increase in gasoline mileage | | 33% | 30% |

The additives of the present invention reduced the friction within the engines and transmissions of the two vehicles during the six mileage tests while resulting in improved gasoline mileage.

It is therefore to be understood that even though numerous characteristics and advantages of the present invention have been set forth in the foregoing description, together with details of the structure and function of the invention, the disclosure is illustrative only, and changes may be made within the principles of the invention to the full extent indicated by the broad general meaning of the terms in which the appended claims are expressed and reasonable equivalents thereof.

We claim:

1. A liquid lubricant additive formulation comprising the following composition in wt. %:

33–65 naphthenic oil;

2–24 paraffinic oil; and

30–50 chlorinated paraffin.

2. The formulation of claim 1 further comprising up to 20 wt. % metal powders which are non-soluble in oil.

3. The formulation of claim 2 wherein said metal powders are selected from the group consisting of copper, lead and zinc.

4. The formulation of claim 2 wherein up to 11 wt. % grease has been added as a thickener.

5. The formulation of claim 4 wherein said grease is a lithium-based grease.

6. The formulation of claim 1 wherein said composition contains at least 50 wt. % naphthenic oil.

7. The formulation of claim 1 wherein said composition contains at least 11 wt. % paraffinic oil.

8. The formulation of claim 1 wherein said composition contains at least 33 wt. % chlorinated paraffin.

9. The formulation of claim 1 wherein said composition comprises 50 wt. % naphthenic oil, 6 wt. % paraffinic oil, 42 wt. % chlorinated paraffin, 2 wt. % 2,5-dimercapto-1,3,4-thiadiazole derivative and 2 wt. % tall oil fatty acid diethanolamide.

10. A non-phosphate liquid lubricant additive formulation comprising the following composition in wt. %:

20–65 naphthenic oils;

25–50 chlorinated paraffins;

2–40 paraffin oils;

up to 20 selected from the group consisting of copper, lead and zinc metal powders which are non-souluble in oil.

11. The formulation of claim 10 wherein said composition includes up to 20 wt. % graphite.

12. The formulation of claim 10 wherein said composition comprises in wt. %:

35–45 naphthenic oil;

40–45 chlorinated paraffin;

4–4.5 paraffin oil; and

5–7 of a metal powder selected from the group consisting of copper, lead and zinc.

13. The formulation of claim 12 wherein up to 11 wt. % grease has been added as a thicker.

14. The formulation according to claim 10 or 13 wherein said grease is a lithium based grease.

15. The composition according to claim 12 wherein said metal powders are spherical in shape of a size less than 20 microns.

16. The composition according to claim 15 wherein said metal powders are copper and lead.

17. The composition according to claim 16 in which the ratio of copper to lead is 20% to 80% copper to 80% to 20% lead.

18. The composition according to claim 17 wherein the ratio of naphthenic oil to originated paraffin is approximately 1:1.

* * * * *